US007227500B2

(12) United States Patent
Oshima et al.

(10) Patent No.: US 7,227,500 B2
(45) Date of Patent: Jun. 5, 2007

(54) PLANAR ANTENNA AND METHOD FOR DESIGNING THE SAME

(75) Inventors: Hideaki Oshima, Minato-ku (JP); Tatsuo Matsushita, Minato-ku (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 143 days.

(21) Appl. No.: 10/516,632

(22) PCT Filed: Jun. 11, 2003

(86) PCT No.: PCT/JP03/07417

§ 371 (c)(1),
(2), (4) Date: Dec. 1, 2004

(87) PCT Pub. No.: WO03/105278

PCT Pub. Date: Dec. 18, 2003

(65) Prior Publication Data

US 2005/0179593 A1 Aug. 18, 2005

(30) Foreign Application Priority Data

Jun. 11, 2002 (JP) ..... 2002-169471

(51) Int. Cl.
*H01Q 1/38* (2006.01)

(52) U.S. Cl. ..... 343/700 MS; 343/700 MS; 343/711; 343/712; 343/713

(58) Field of Classification Search ..... 343/700 MS, 343/712, 713, 767, 770, 711
See application file for complete search history.

(56) References Cited

U.S. PATENT DOCUMENTS 4,873,529 A * 10/1989 Gibson ..... 343/700 MS
6,140,968 A * 10/2000 Kawahata et al. ... 343/700 MS
6,198,437 B1 * 3/2001 Watson et al. ..... 343/700 MS
6,480,170 B1 * 11/2002 Langley et al. ..... 343/826
6,639,556 B2 * 10/2003 Baba ..... 343/700 MS
2003/0189520 A1 * 10/2003 Goto et al. ..... 343/702
2004/0169605 A1 * 9/2004 Komatsu et al. ..... 343/700 MS

FOREIGN PATENT DOCUMENTS

JP 63-31849 2/1988
JP 8-148921 A 6/1996
JP 2000-151259 A 5/2000

OTHER PUBLICATIONS

Misao Haishi et al., Saishin Heimen Antenna Gijutsu, 1st edition, Kabushiki Kaisha Sogo Gijutsu Center, Mar. 25, 1993, pp. 216-223.

* cited by examiner

*Primary Examiner*—Hoang V. Nguyen
*Assistant Examiner*—Dieu Hien Duong
(74) *Attorney, Agent, or Firm*—RatnerPrestia

(57) ABSTRACT

A coplanar type circularly polarize wave planar antenna is provided, which can be formed on one side of a dielectric substrate. The planar antenna comprises a dielectric substrate; an almost square radiating element formed on one main surface of the dielectric substrate, the radiating element having notched portions at two corners opposing in one diagonal direction; and a ground conductor formed on the one main surface, the ground conductor having a square opening portion at a center portion thereof and a square outer peripheral shape. The radiating element is placed inside the opening portion of the ground conductor with a gap of a predetermined width being provided with respect to the ground conductor.

6 Claims, 5 Drawing Sheets

PLANAR ANTENNA AND METHOD FOR DESIGNING THE SAME

This application is a National Stage application of co-pending PCT application No. PCT/JP03/07417 Jun. 11, 2003.

TECHNICAL FIELD

The present invention relates generally to a circularly polarized wave antenna for a microwave band used in satellite broadcasts, satellite communications and the like, and more particularly to a structure of a planar antenna suitable to be provided on a window glass of a vehicle. The present invention furthermore relates to a method for designing such a planar antenna.

BACKGROUND ART

As a circularly polarized wave antenna for a microwave band used in satellite broadcasts, satellite communications and the like, a micro strip antenna (MSA) is prevailing, which is a planar antenna that includes a radiating element on the surface of a dielectric substrate and a ground conductor on the back thereof.

In FIG. 1, there is shown one example of the MSA, Reference numeral 10 denotes a dielectric substrate, 12 an almost square radiating element, and 14 a ground conductor. Where such MSA is provided on a window glass of a vehicle, the dielectric substrate 10 is structured by the window glass of a vehicle, the radiating element is patterned on the outer surface of the window glass, and the ground conductor is patterned on the inner surface of the window glass. Feeder lines are connected to the radiating element and ground conductor, respectively, but the feeder line to the radiating element has to be provided passing through the window glass, which is hard for the vehicle window glass. Consequently, it is difficult to form the MSA on the window glass of a vehicle.

DISCLOSURE OF THE INVENTION

An object of the present invention is to avoid the problem as described above and provide a circularly polarized wave planar antenna of a coplanar type, which may be formed on one side of a dielectric substrate.

Another object of the present invention is to provide a method for designing the above-described circularly polarized wave planar antenna.

The inventors of the present application have found that, even when the ground conductor of the conventional MSA shown in FIG. 1 is moved to the surface of a glass window on which the radiating element is provided to surround the radiating element, the structure thus formed functions as a circularly polarized wave antenna.

Hence, a first aspect of the present invention is a planar antenna comprising a dielectric substrate; an almost square radiating element formed on one main surface of the dielectric substrate, the radiating element having notched portions at two corners opposing in one diagonal direction; and a ground conductor formed on the one main surface, the ground conductor having a square opening at a center portion thereof and a square outer peripheral shape; wherein the radiating element is placed inside the opening of the ground conductor with a gap of a predetermined width being provided with respect to the ground conductor.

A second aspect of the present invention is a method for designing the planar antenna, wherein a diagonal line length in the other diagonal direction where no notched portions of the radiating element are provided is deemed as A, the diagonal line length in the one diagonal direction as B, a width of the gap between the radiating element and the ground conductor as G, and a length of one edge of the square peripheral shape of the ground conductor as W, the method comprising the steps of deciding the diagonal line length A so that the planar antenna resonates with a predetermined frequency, deciding the diagonal line length B based on a first linear function relationship between a resonance frequency of the planar antenna and a diagonal line length ratio B/A, deciding said gap width G based on a second linear function relationship between the diagonal line length ratio B/A and a ratio G/A, and deciding the length W of one edge of the square peripheral shape based on an exponential function relationship between a gradient coefficient of a linear expression representing the second linear function relationship and a ratio W/A.

In the case where the above-described planar antenna is provided on the window glass of a vehicle, the dielectric substrate is a window glass of a vehicle, and the radiating element and the ground conductor are formed on the inner surface of the window glass.

BEST MODE FOR CARRYING OUT THE INVENTION

Figure 1:
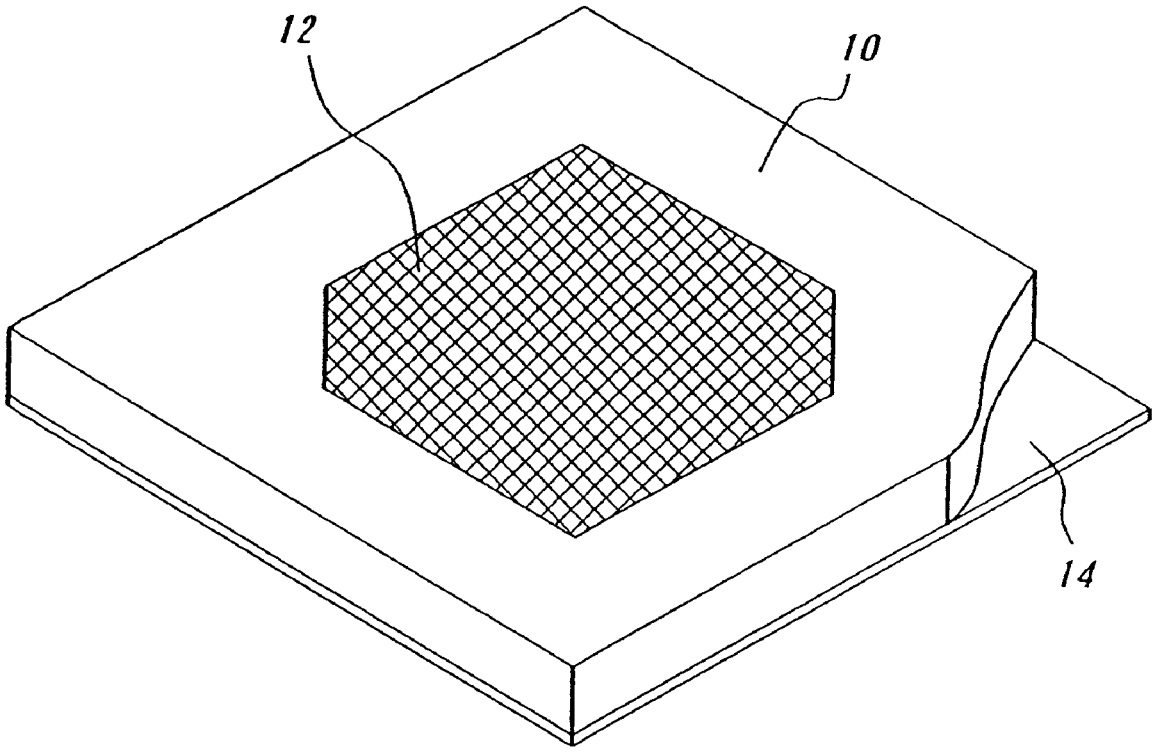
FIG. 1 PRIOR ART
FIG. 1 is a view showing one example of a micro strip antenna (MSA)
Figure 2:
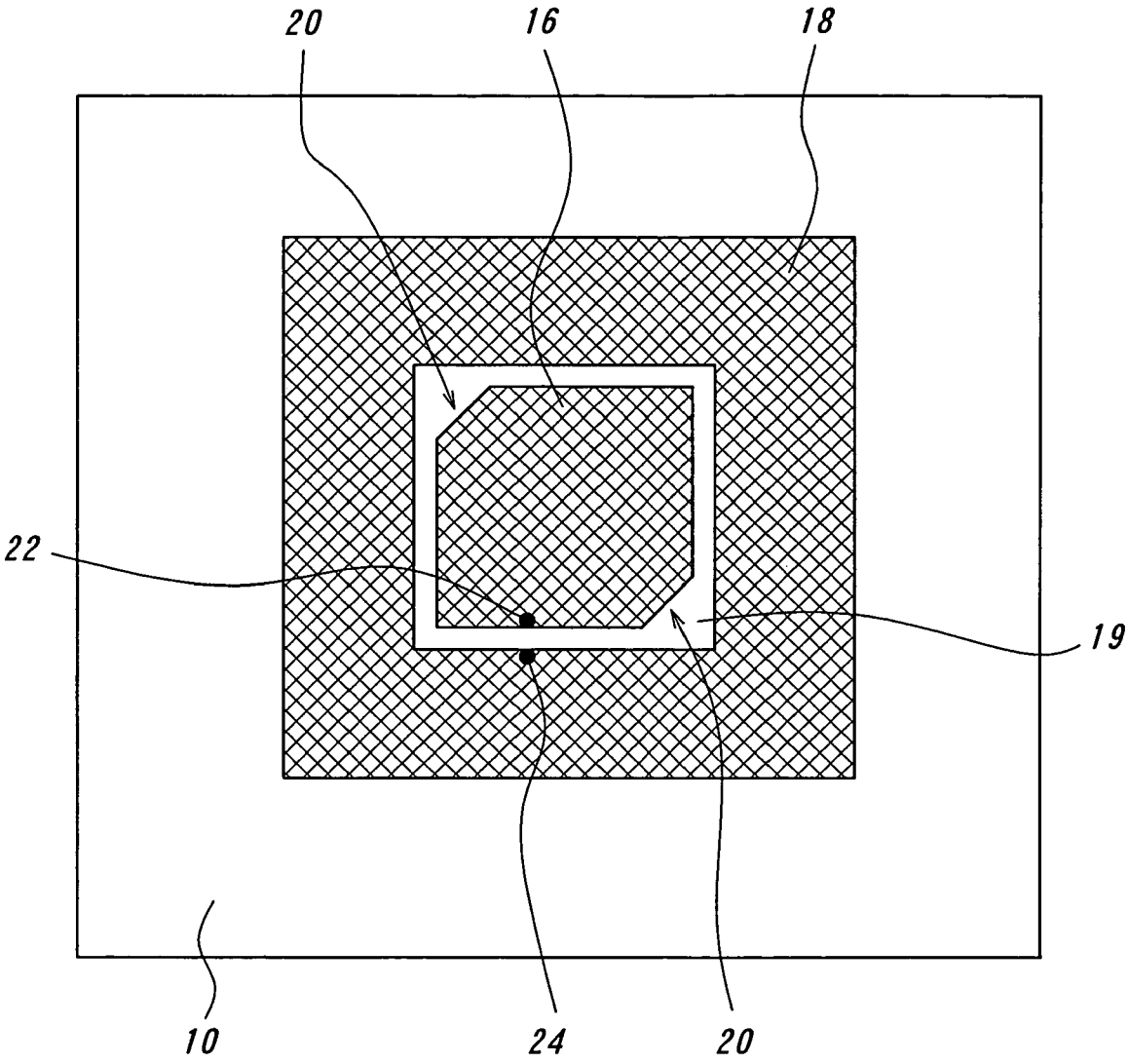
FIG. 2 is a view showing one embodiment of a planar antenna of the present invention.

FIG. 2 is a view showing one embodiment of a planar antenna of the present invention. This planar antenna comprises an antenna pattern as illustrated in the drawing on one main surface of a dielectric substrate 10. This antenna pattern is composed of an almost square radiating element 16 and a ground conductor 18 which surrounds the radiating element and has a square outer peripheral shape. In this case, the radiating element 16 is placed inside a square opening portion 19 formed at the center portion of the ground conductor 18. The radiating element 16 has notched portions 20 formed at its two corner portions opposing in one diagonal direction. The reason why such notch portions are formed is to excite a circularly polarized wave as described later. Note that, in this drawing, reference numeral 22 denotes a feeding point to the radiating element and 24 a feeding point to the ground conductor. Actually, by using a coaxial cable, its core wire is connected to the radiating element, and its braided wire is connected to the ground conductor.

Note that, depending on a relative physical relationship between the feeding point and the corner notched portion, the radiating direction of either a levorotation or a dextrorotation is decided. For example, if the physical relationship is constituted as shown in FIG. 2, a levorotation polarized wave is emitted in a direction toward the front side of the drawing and a dextrorotation polarized wave is emitted in a direction toward the back side of the drawing.

Figure 3:
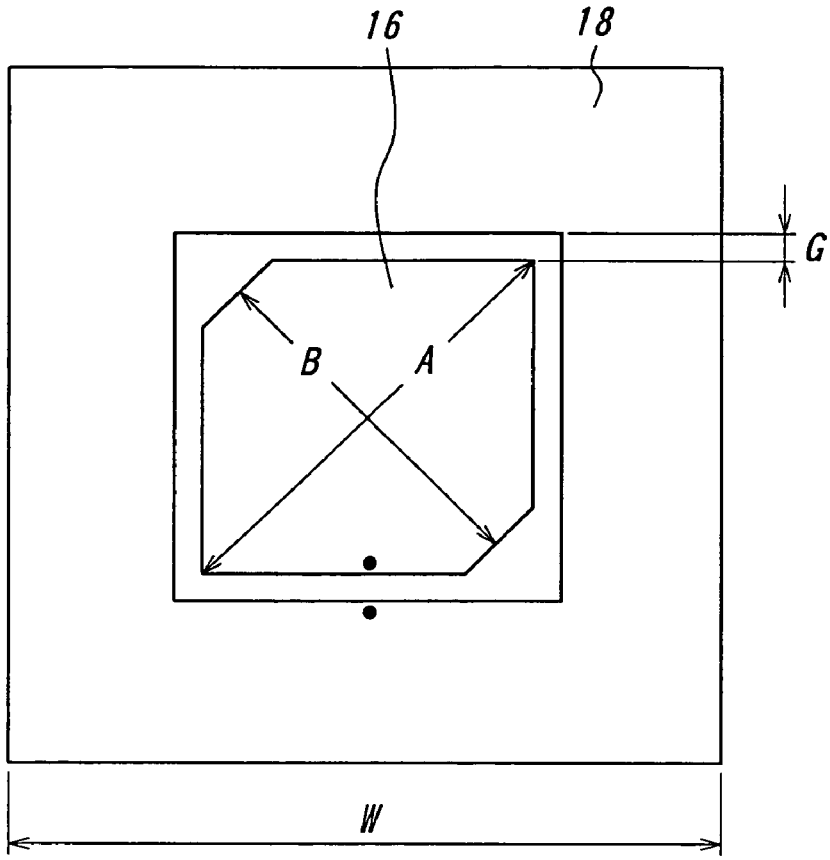
FIG. 3 is a view showing parameters.

In the planar antenna having such an antenna pattern, important parameters to decide an antenna performance are a diagonal line length ratio of the radiating element, a gap width between the radiating element and the ground conductor, and the length of one edge of the square outer peripheral shape of the ground conductor. In FIG. 3, there are shown these parameters. The diagonal line length of the portion where there are no notched portion of the radiating element is shown by A. Similarly, the diagonal line length of the portion in which there are notched portions is shown by B. Likewise, the length of one edge of the square outer peripheral shape of the ground conductor, that is the ground conductor outer one edge length is shown by W, and the gap width between the radiating element and the ground conductor is shown by G. As described above, by providing notched portions in the radiating element, the diagonal line length ratio varies, and a circularly polarized wave excitation may be realized.

The present inventors have found by means of simulation that there is a correlation established among these parameters.

Figure 4:
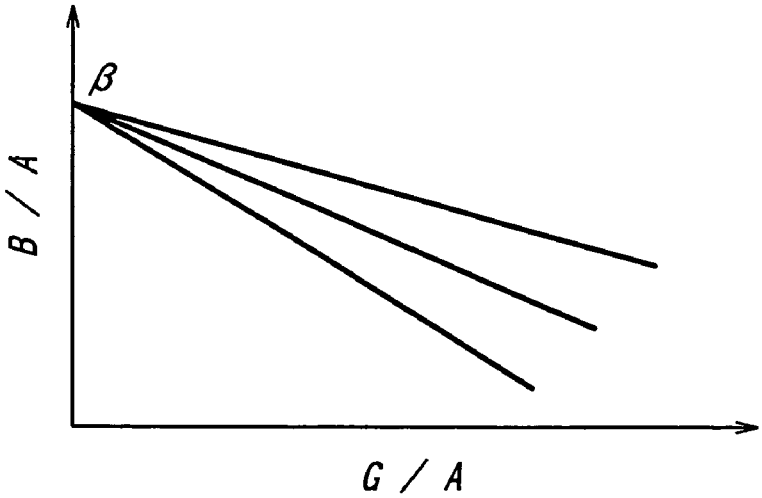
FIG. 4 is a view showing a correlation between a gap width/a diagonal line length ratio G/A and a diagonal line length ratio B/A.
Figure 5:
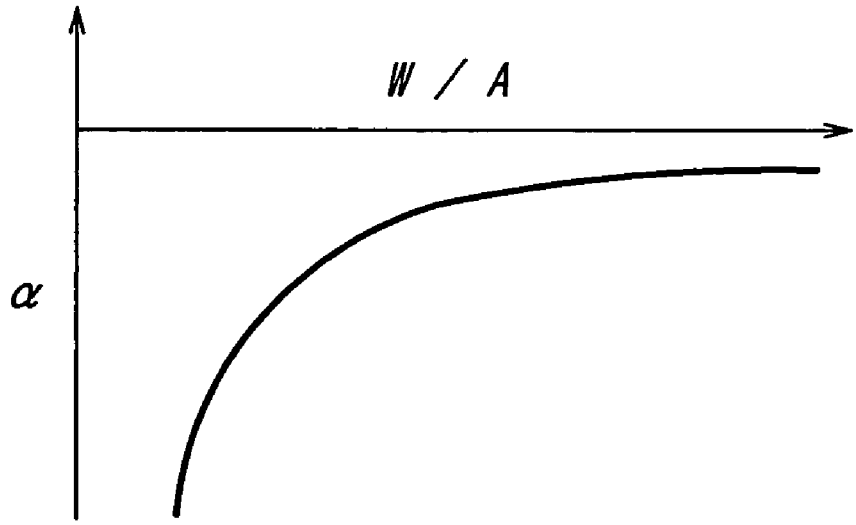
FIG. 5 is a view showing a correlation between a gradient coefficient $\alpha$ and outer one edge length of a ground conductor/a diagonal line length W/A.
Figure 6:
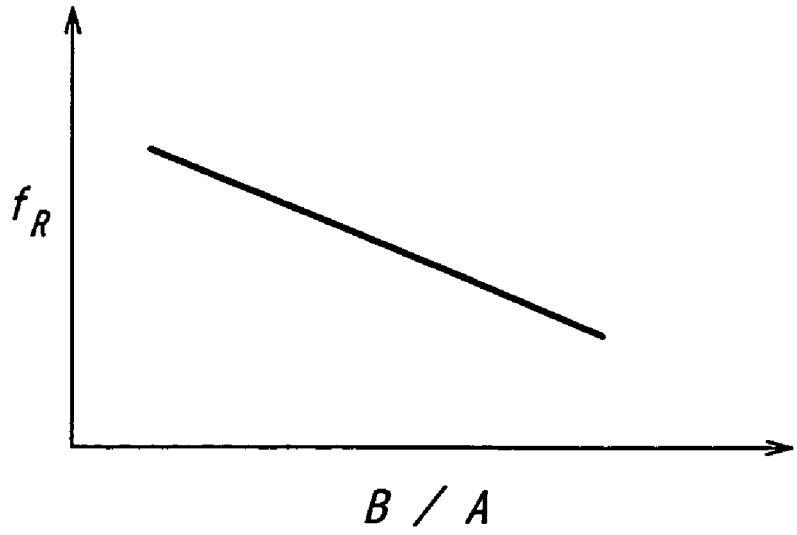
FIG. 6 is a view showing a correlation between a resonance frequency and a diagonal line length ratio B/A of a radiating element.

The ratio G/A and the diagonal line length ratio B/A are in a linear relationship, that is, $B/A=\alpha\cdot(G/A)+\beta$, wherein A is one of diagonal line lengths of the relating element as described above and has a correlation with the resonance frequency $f_R$, and G is a gap width as described above. The linear relationship is shown in FIG. 4. A coefficient $\beta$ is herein constant regardless of the ground conductor outer one edge length W, while a gradient coefficient $\alpha$, as shown in FIG. 5, has a correlation with the ratio W/A of the diagonal line length A to the ground conductor outer one edge length W, thereby establishing an exponential function relationship having a correlation with a natural logarithm. Moreover, as shown in FIG. 6, the resonance frequency is in a linear relationship with the diagonal line length ratio B/A of the radiating element.

When the correlation among the parameters is used as described above, the design of the planar antenna becomes easy.

Figure 7:
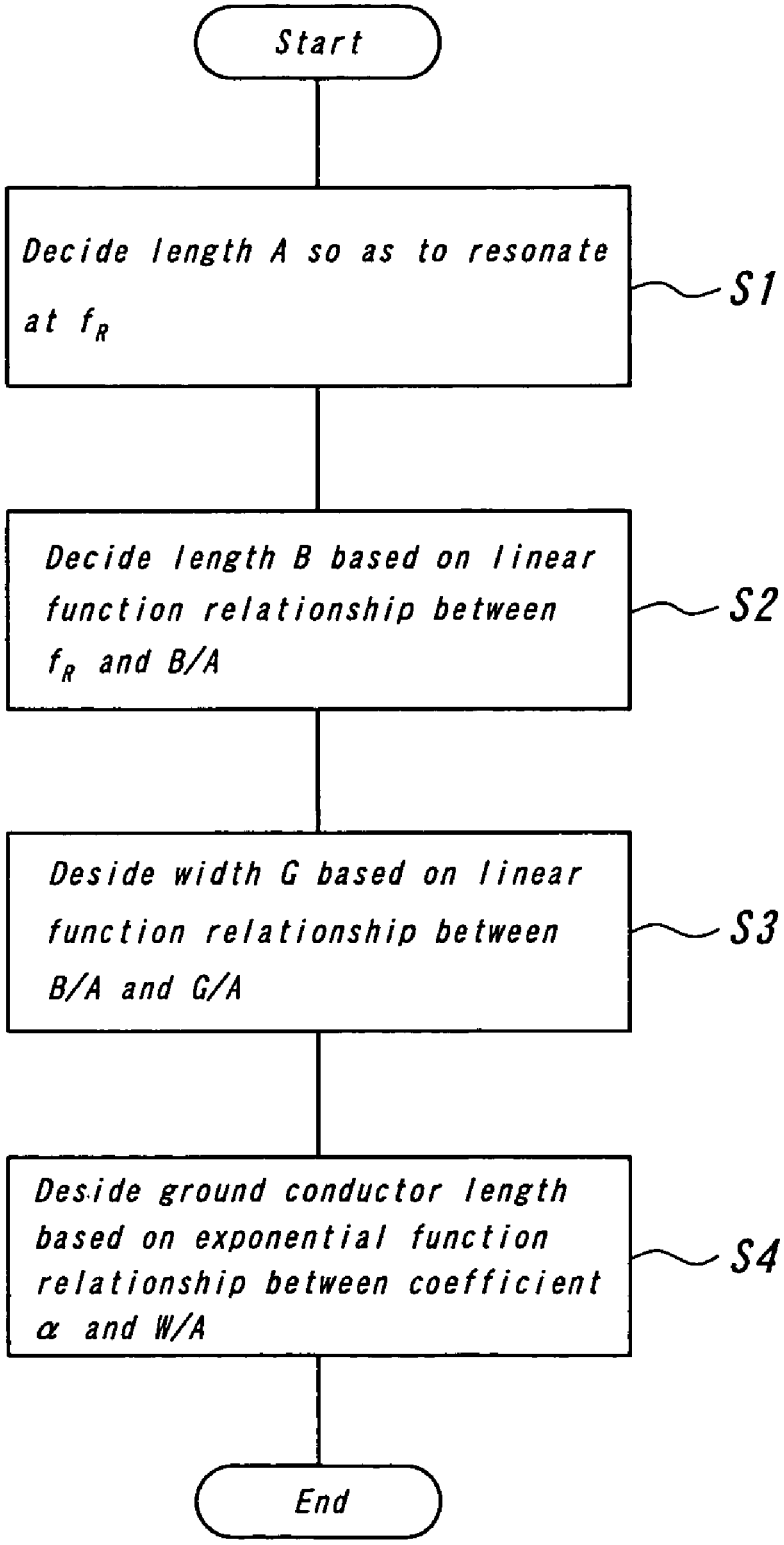
FIG. 7 is a flow-chart diagram that is useful for describing the procedure for designing an MSA.

Hereinafter, the design procedure will be described with reference to the flow chart in FIG. 7.

First, the diagonal line length A of the radiating element is decided so as to resonate in the vicinity of a predetermined frequency $f_R$ (step S1).

Next, based on the linear function relationship between the resonance frequency $f_R$ of the planar antenna and the diagonal line length ratio B/A shown in FIG. 6, the diagonal line length B is decided (step S2).

Next, based on the linear function relationship (a linear expression) between the diagonal line length ratio B/A and the ratio G/A of the gap width G to the diagonal line length A shown in FIG. 4, the gap width G is decided (step S3).

Finally, based on the exponential function relationship between the gradient coefficient $\alpha$ of the linear expression used in the step S3 and the ratio W/A of the ground conductor outer one edge length W to the diagonal line length A shown in FIG. 5, the ground conductor outer one edge length W is decided.

In this way, the diagonal line length A of the radiating element is decide so that the radiating element resonates in the vicinity of a predetermined frequency and then each shape parameter is decided so as to establish the above-described correlation, thereby implementing a circularly polarized wave antenna having a good radiating characteristic.

One example of the size of the planar antenna designed as described above is shown in Table 1.

An antenna pattern is formed on a glass plate having a thickness of 3.5 mm (relative dielectric constant 7).

TABLE 1

| Resonance frequency (GHz) | G (mm) | W (mm) | A (mm) | B (mm) |
|---|---|---|---|---|
| 1.37 | 0.5 | 80 | 42.42 | 36.17 |
| 1.42 | 1 | 80 | 42.42 | 34.59 |
| 1.46 | 1.5 | 80 | 42.42 | 33.07 |

INDUSTRIAL APPLICABILITY

According to the present invention, different from the conventional MSA, all of the antenna patterns may be formed on one side of the dielectric substrate and it is, therefore, possible to provide an antenna having a good circularly polarized wave radiating characteristic same as the MSA on a vehicle glass.

Moreover, since the correlation of the shape parameters important for deciding an antenna performance is clear, the design of the antenna becomes easy.

According to the present invention, therefore, a circularly polarized planar antenna of a coplanar type that may be formed on one side of a dielectric substrate and a method for designing such a circularly polarized planar antenna may be realized.

The invention claimed is:

1. A planar antenna, comprising:

a dielectric substrate;

an almost square radiating element formed on one main surface of said dielectric substrate, said radiating element having notched portions at two corners opposing in one diagonal direction; and a ground conductor formed on said one main surface, said ground conductor having a square opening portion at a center portion thereof and a square outer peripheral shape;

wherein said radiating element is placed inside the opening portion of said ground conductor with a gap of a predetermined width being provided with respect to said ground conductor, and said ground conductor continuously surrounds said radiating element.

2. The planar antenna according to claim 1, wherein said dielectric substrate is a window glass of a vehicle, and said radiating element and ground conductor are formed on an inner surface of said window glass.

3. The planar antenna according to claim 1, wherein said planar antenna receives a circularly polarized wave of a microwave band.

4. A method for designing a planar antenna of claim 1, wherein a diagonal line length in the other diagonal direction where no notched portions of said radiating element are provided is deemed as A, the diagonal line length in said one diagonal direction as B, a width of said gap between said radiating element and said ground conductor as G, and a length of one edge of the square peripheral shape of said ground conductor as W, said method comprising the steps of:

deciding said diagonal line length A so that the planar antenna resonates with a predetermined frequency, deciding said diagonal line length B based on a first linear function relationship between a resonance frequency of the planar antenna and a diagonal line length ratio B/A, deciding said gap width G based on a second linear function relationship between said diagonal line length ratio B/A and a ratio G/A of said A to said G, and deciding said length W of one edge of the square peripheral shape based on an exponential function relationship between a gradient coefficient of a linear expression representing said second linear function relationship and a ratio W/A of said A to said W.

5. The method according to claim 4, wherein said dielectric substrate is a window glass of a vehicle and said radiating element and ground conductor are formed on an inner surface of said window glass.

6. The method according to claims 4 or 5, wherein said planar antenna receives a circularly polarized wave of a microwave band.

* * * * *